US006207908B1

(12) United States Patent
Miyata

(10) Patent No.: US 6,207,908 B1
(45) Date of Patent: Mar. 27, 2001

(54) MODE SWITCH

(75) Inventor: Muneyoshi Miyata, Tokyo (JP)

(73) Assignee: Mitsuku Denki Kogyo K.K., Tokyo (JP)

( * ) Notice: Subject to any disclaimer, the term of this patent is extended or adjusted under 35 U.S.C. 154(b) by 0 days.

(21) Appl. No.: 09/270,679

(22) Filed: Mar. 16, 1999

(30) Foreign Application Priority Data

Aug. 31, 1998 (JP) ..... 10-244841
Dec. 15, 1998 (JP) ..... 10-356388

(51) Int. Cl.[7] ..... H01H 19/62
(52) U.S. Cl. ..... 200/6 BB; 200/569
(58) Field of Search ..... 200/569, 11 G, 200/6 BB, 568

(56) References Cited

U.S. PATENT DOCUMENTS 3,019,308 * 1/1962 Ellithorpe ..... 200/11 G
4,133,990 * 1/1979 Wanner et al. ..... 200/6 BB
4,527,023 * 7/1985 Ohashi et al. ..... 200/11 G
4,539,444 * 9/1985 Sench ..... 200/6 BB
5,792,766 * 8/1998 Morita et al. ..... 200/569

* cited by examiner

*Primary Examiner*—Renee Luebke
(74) *Attorney, Agent, or Firm*—Oblon, Spivak, McClelland, Maier & Neustadt, P.C.

(57) ABSTRACT

A mode switch is provided that consists of a base, a rotor, a contact spring piece plate and an actuator plate. Movable contacts of contact spring pieces of the contact spring piece plate are relatively and separately mounted over stationary contacts on the base. Actuators of the actuator plate are placed over the contact spring pieces of the contact spring piece plate. The rotor is placed over the actuator plate and is rotatably attached to the base.

20 Claims, 14 Drawing Sheets

PRIOR ART FIG.25
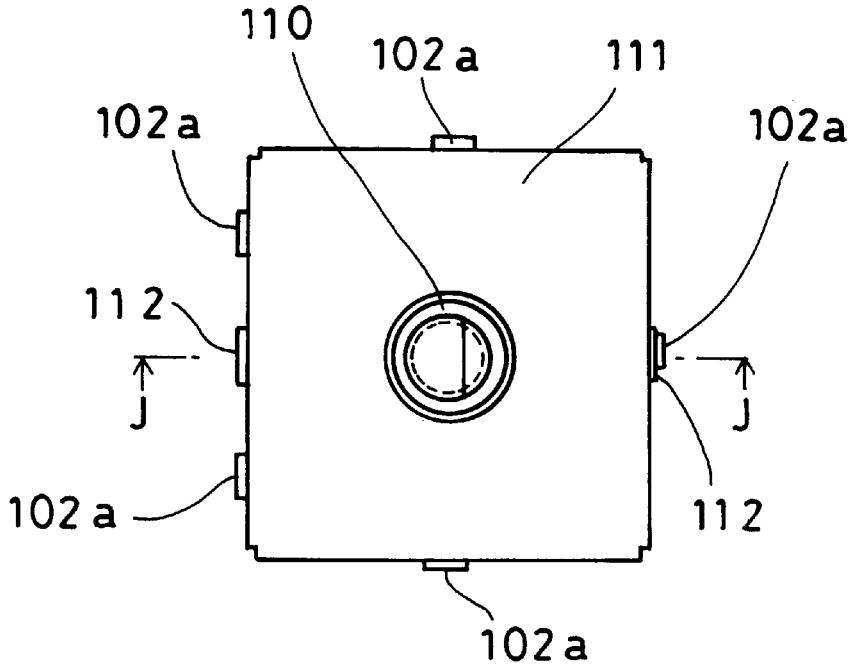
PRIOR ART FIG.26
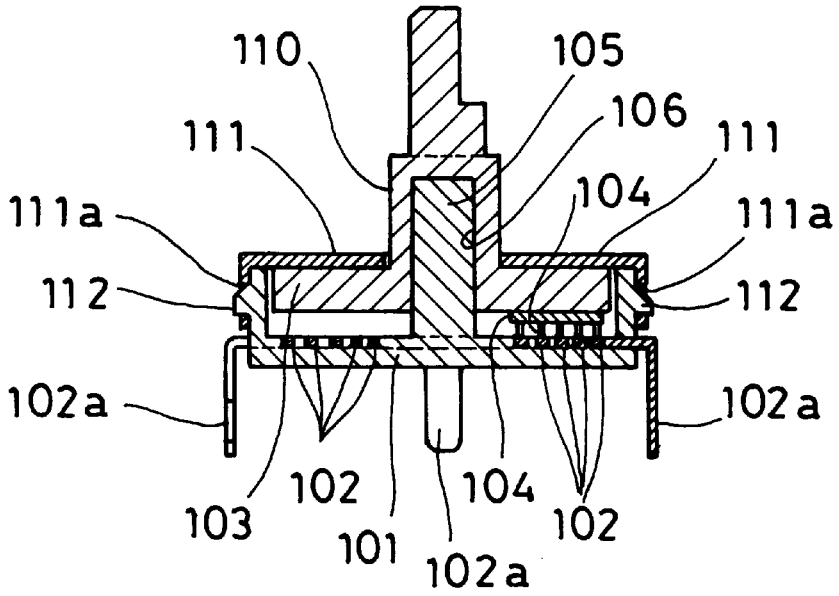

PRIOR ART FIG.27
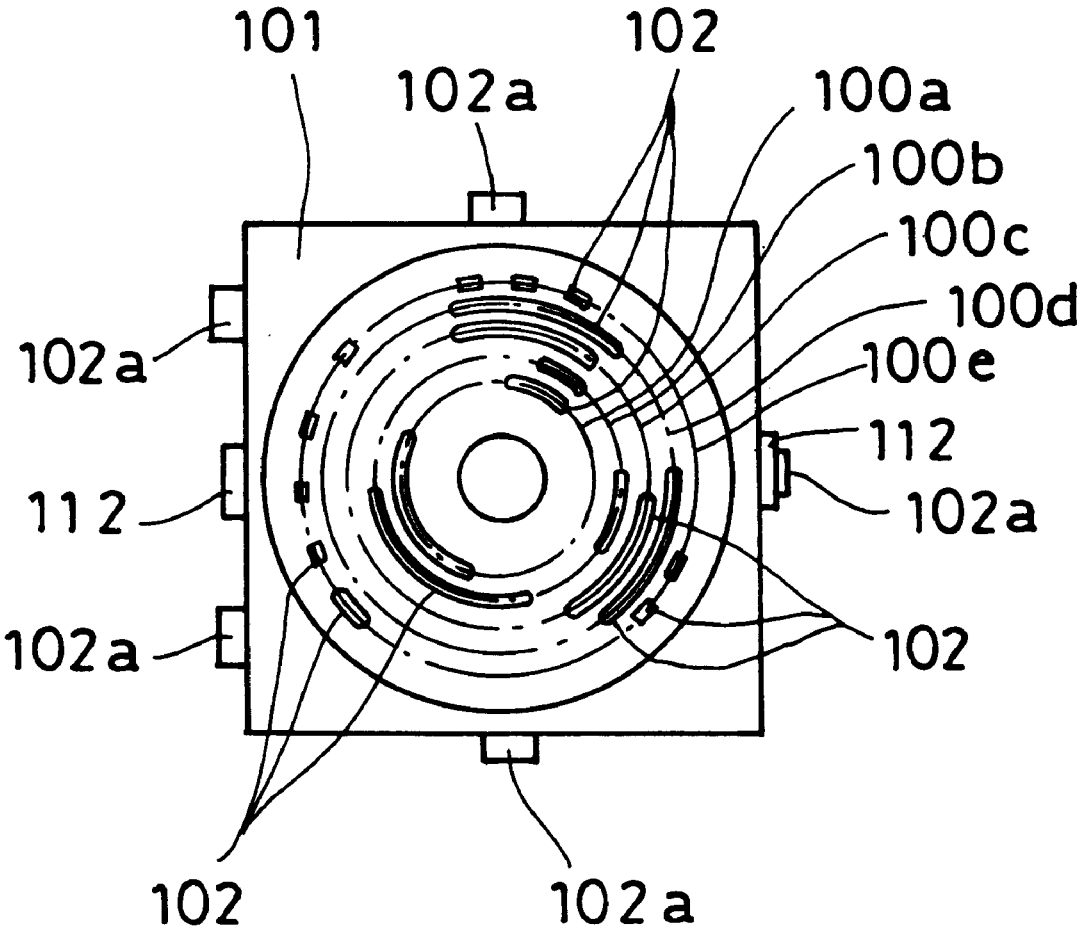

MODE SWITCH

BACKGROUND OF THE INVENTION

The present invention relates to an improved mode switch.

A typical conventional mode switch is shown in FIGS. 25, 26 and 27. The conventional mode switch includes arc stationary contacts 102 with respective predetermined lengths exposed and formed in the form of plural concentric circles on the upper surface of a base 101, and a single comb-like movable contact spring piece (generally called brush) 104 attached on the lower surface of a disc rotor 103 and having plural contact spring pieces arranged in parallel with one ends acting as contacts. The center shaft 105 on the base 101 is rotatably fitted to the center hole 106 in the rotor 103. The contacts of the movable contact spring piece 104 sliding over the upper surface of the base 101 in a contact state are slidably and sequentially contacted to the stationary contacts 102 (or are turned ON) by rotating the rotor 103. When the contacts of the movable contact spring pieces 104 are opened from the stationary contacts 102 (or come to the positions where the stationary contacts 102 are not exposed), the mode switch is turned OFF.

Generally, in order to rotatably mount the rotor 103 to the base 101 without dropping, the mounting cover 111 for covering the whole surface of the rotor 103 is attached to the base 101 by inserting the engaging protrusions 112 of the base 101 into the engaging holes 111*a* in the right and left side plates.

Since the movable contact spring piece 104 always slides under pressure on the inner surface of the base 101 (on the insulating surface and stationary contacts), together with the rotor 103 rotated, grease is always applied on the movable contact spring piece 104, so that the rotation of the rotor 103, that is, the sliding of the movable contact spring piece 104 although always in contact with the inner surface of the base is always maintained smooth.

A loss of such smoothness causes erroneous signal reception or noise mixture.

However, the use of grease leads to the following drawbacks:

(1) A grease film formed on the contact surface of a contact may interfere with good electrical conduction of the contact.

(2) Particles or dusts caused by the friction during the sliding operation contaminate the grease and degrades the lubrication or conduction.

The grease may solidify or be degraded during a long service period, thus deteriorating the lubrication, conduction, or the like.

As described above, since the metal movable contact spring piece 104 directly slides over the metal stationary contacts 102 under pressure, metal particles produced in the sliding and polishing operation tend to cause a contact failure. Thus, variations in contact state at different portions result in noises. For that reason, a mode switch that does not use any grease and does not have its contacts slidably contacted to each other has been long desired.

In the mode switch, the stationary contacts 102 on the base 101 must be always juxtaposed with the contacts of the movable contact spring piece 104 on the lower surface of the rotor 103 with high precision with no variations in mode switches. In order to realize such requirements, the fitting accuracy must be set between the center shaft 105 of the base 101 and the center hole 106 of the rotor 103 must be fit together as accurately as possible and set a gap between the outer diameter of the shaft and the inner diameter of the shaft hole as small as possible. Since the rotor must be lightly rotated by a very small rotational force, the shaft is loosely fitted to the gap which allows sufficient mobility. The base and the rotor are a molded pieces made of general-purpose plastic (not special plastic for expense precision devices). Hence, variations in these molded products may cause irregular rotation of the rotor.

Moreover, in the conventional mode switch, in order to prevent the irregular rotation, the resilient recovery force of the movable contact spring piece presses the upper surface of the rotor against the lower surface of a mounting cover which covers the whole surface of the rotor and which prevents the rotor from being dropped off, thus stopping the moving of the rotor. However, the mounting covers, which are formed through a sheet metal shaping process under pressure, varies in their dimensions means for attaching the mounting cover to the base, for example, the engagement between the mounting cover engaging hole and the engaging protrusion on the base, requires high precision in their dimensions. Hence, variations in spacing in each switch make it difficult to improve the switching performance.

In the conventional mode switch, the rotor must be attached with a different mounting cover. This makes it difficult to reduce the number of constituent components for a mode switch the fabrication steps and the manufacturing costs, and also to improve the productivity.

SUMMARY OF THE INVENTION

An objective of the present invention is to provide a mode switch that does not require any grease and does not have its contacts slidably contacting to each other.

The objective of the present invention is achieved by a mode switch comprising a base, a rotor, a contact spring piece plate, and an actuator plate.

More specifically, the rotor is made of an insulation disc plate, a hollow center shaft protruding at the center of the lower surface of the insulation disk plate, a circumferential side plate protruding on the outer circumferential fringe of the insulation disc plate, engaging rims protruding from the outer circumferential fringe, and a predetermined number of arc protruding stripes or protrusions of a predetermined length arranged on the insulation disc plate and at predetermined positions on a predetermined number of assumed concentric circles centered with respect to the hollow center shaft.

The base is made of a circular insulation substrate, a center shaft protruding from the center of an upper surface of the circular insulation substrate to be fitted into the hollow center shaft of the rotor, engaging pieces planted along outer circumference of the engaging rims of the insulation substrate at angles set on an assumed concentric circle, engaging pieces having edges acting as engaging pawls, and circumference protruding stripes fitted to the circumferential side plate of the rotor with respect to the center shaft.

Guide pillars face the concentric circles on the rotor imaginarily drawn around the center shaft on the rotor and being provided adjacent to the concentric circles. The guide pillars have guide grooves or holes respectively positioned along the concentric circles, stationary contacts being exposed and formed on the base at positions adjacent to the concentric circles, the stationary contacts respectively extending to terminals outside the insulation substrate, the guide pillars being provided at positions bilaterally symmetrical to the center shaft to fit the contact spring piece plate and the actuator plate.

The contact spring piece plate has a predetermined number of strip-like contact spring pieces integrally and protrusively formed on the lower sides of right plates and left plates of sectoral metal spring pieces, the contact spring plate having one ends acting as movable contacts, each of the right plates and the left plates having mounting holes for fitting the pillars of the base, and movable contacts of the contact spring pieces being positioned so as to be relatively spaced above the stationary contacts on the base while the contact spring piece plate is attached to the base.

The actuator plate is formed of an insulation plate of the substantially same shape as the contact spring piece plate, and having actuators positioned so as to respectively face with the contact spring pieces of the contact spring piece plate; the actuator plate having insertion holes positioned so as to face the mounting holes in the contact spring piece plate. An angled-top-like actuators are integrally formed on the ends of strip-like spring piece integrally protruding from the right and left side lower portions of the insulation plate. The guide protrusions engaging with the guide grooves or holes for guide pillars of the base are formed on the right and left side surfaces of the actuator.

The contact spring piece plate is mounted to the base by inserting the right and left support pillars into the right and left mounting holes of the contact spring piece plate; the movable contacts on one ends of the contact spring pieces being relatively spaced from the stationary contacts on the base.

The actuator plate is placed over the contact spring piece plate by inserting the right and left support pillars of the base into the right and left insertion holes. The actuators are in contact with the contact spring pieces. The guide protrusions of the actuators are vertically and movably engaged with the guide grooves or holes in the guide support pillars on the base, respectively.

The rotor is placed over the actuator plate. The rotor is rotatably mounted to the base by inserting the hollow center shaft thereof to the center shaft of the base, by inserting the circumferential protruding stripes of the base into the circumferential side plate and by engaging the engaging pawls of the engaging piece of the base with the engaging rims of the circumferential side plate.

When the rotor is rotated, the protruding stripe or protrusion on the lower surface of the rotor collides with and runs on the actuator, thus vertically pushing down the contact spring piece under the guidance of the guide protruding groove or hole, so that the movable contact at one end thereof makes contact with the stationary contact under pressure (or switched ON).

When the rotor is further rotated, the actuator crosses over the protruding stripe or protrusion, so that the contact spring piece is resiliently restored, the actuator vertically rises to its original position, and the movable contact is separated from the stationary contact (or switched OFF).

In the mode switch according to the present invention, the actuators formed on the ends of the spring pieces of the actuator plate are arbitrarily formed in an angled top shape, short column shape, spherical shape, or rotatable roller shape. Each of the actuators has guide protrusions or shafts protruding on the right and left side surfaces thereof. Guide support pillars are planted on the base so as to be vertically and movably engaged to vertical guide grooves or holes. The actuators are placed on a contact spring piece and are inserted between contact spring pieces and the rotor, with the upward biasing force of the contact spring pieces pressing against the lower surface of the rotor. The actuators vertically move by the height of the protruding stripes or protrusions of the rotor, thus transmitting the vertical movement to the contact spring pieces under the guidance of the guide groove or hole to reversely bend the contact spring piece by the same distance.

Moreover, in the mode switch according to the present invention, the contact time interval (switch ON time) and the separation time interval (switch OFF time) between a movable contact and a stationary contact as well as the timing thereof can be arbitrarily programmed by adjusting the arc lengths, positions and spaces of the protruding stripes or protrusions which protrude on the assumed concentric circles drawn on the lower surface of the rotor.

In the mode switch according to the present invention, the engaging pawls of the engaging pieces planted on the base have beveled upper surfaces. The engaging rims protruding on the outer circumferential surface of the circumferential side plate of the rotor have beveled lower surfaces. The upper beveled surface and the lower beveled surface slidably guide the rotor for smooth fitting when the rotor is fitted between the engaging pieces of the base so as to bend each engaging piece outward.

BRIEF DESCRIPTION OF THE DRAWINGS

This and other objects, features and advantages of the present invention will become more apparent upon a reading of the following detailed description and drawings, in which:

FIG. 25 is a front view illustrating a conventional mode switch;

FIG. 26 is a cross-sectional view illustrating the conventional mode switch, taken along the line J—J in FIG. 25; and FIG. 27 is a front view illustrating the base in the conventional mode switch shown in FIG. 25.

DETAILED DESCRIPTION OF THE PREFERRED EMBODIMENTS

Figure 1:
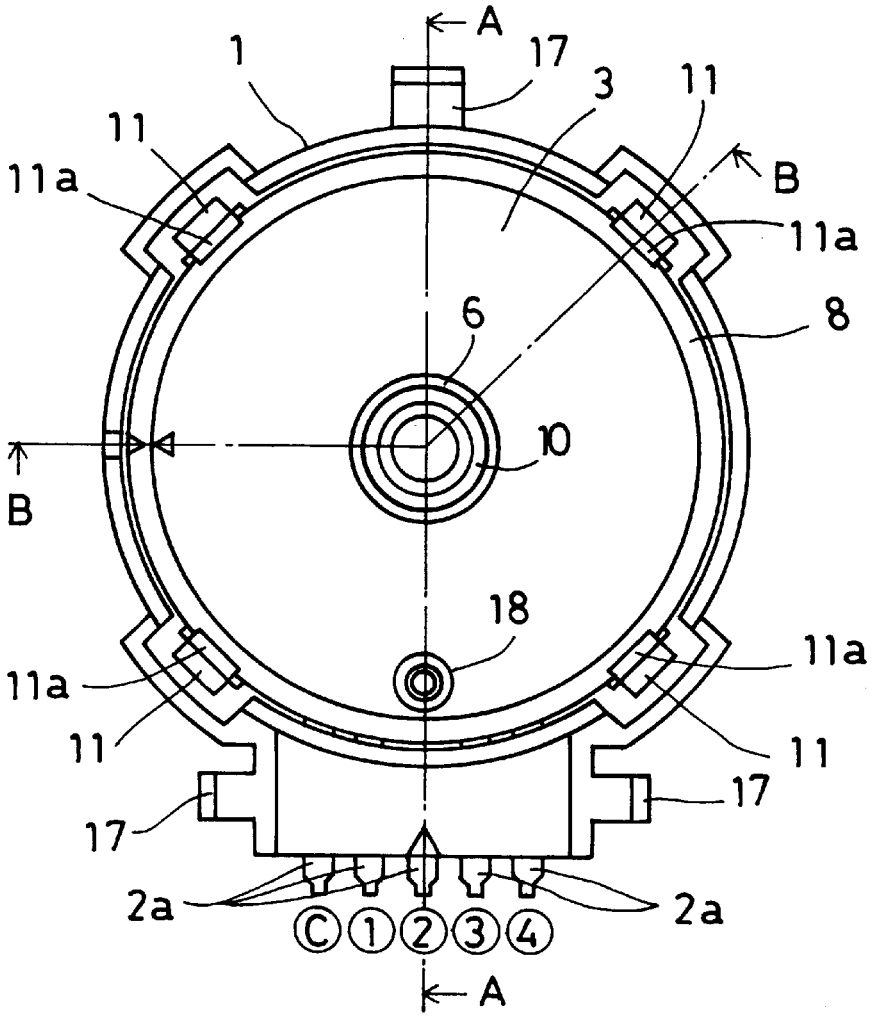
FIG. 1 is a front view illustrating a mode switch according to the present invention.

Next, embodiments of the present invention will be described below in detail with reference to the attached drawings.

Referring to FIGS. 1 to 24, a mode switch according to an embodiment of the present invention will be now described. The mode switch comprises of a base 1, a rotor 3, a contact spring piece plate 4*a* and an actuator plate 5*a*.

Referring to FIGS. 16 to 19, the rotor 3 has a hollow center shaft 6 protruding at the center of the lower surface of an insulation disk, a circumferential side plate 7 protruding along the outer fringe of the disk, and engaging rims 8 protruding from the outer peripheral surface. A predetermined number of arc protruding stripes or protrusions 9 of a predetermined length are formed at predetermined positions along a predetermined number of concentric circles a, b, c, d and e imaginarily drawn with respect to the hollow center shaft 6.

Referring to FIGS. 10 to 15, the base 1 has a center shaft 10, engaging pieces 11 and a circumferential stripe 12. The center shaft 10 protrudes from the center of the upper surface of a circular insulation substrate to be fitted to the hollow center shaft 6 of the rotor 3. Each engaging piece 11 has a protruding engaging pawl 11*a* on one end and protrudes at a set angle on the assumed concentric circles drawn along the outer circumference of the engaging rim of the rotor 3. The circumferential stripe 12 which fits to the circumferential side plate 7 of the rotor 3 protrudes with respect to the center shaft 10.

Guide support pillars 13 protrude adjacent to the concentric circles a', b', c', d' and e' set relative corresponding to the concentric circles a, b, c, d and e on the rotor 3 drawn with respect to the center shaft 10. The guide grooves or holes 13*a* are aligned with the concentric circles a', b', c', d' and e'. Stationary contacts 2 are exposed and formed near guide support pillars 13. Terminals 2*a* are derived from the stationary contacts 2 and protrude out of the insulation substrate.

The support pillars 14 to which the contact spring piece plate 4*a* and the actuator plate 5*a* are fitted are provided at the positions bilaterally symmetrical with respect to the center shaft 10.

Figure 20:
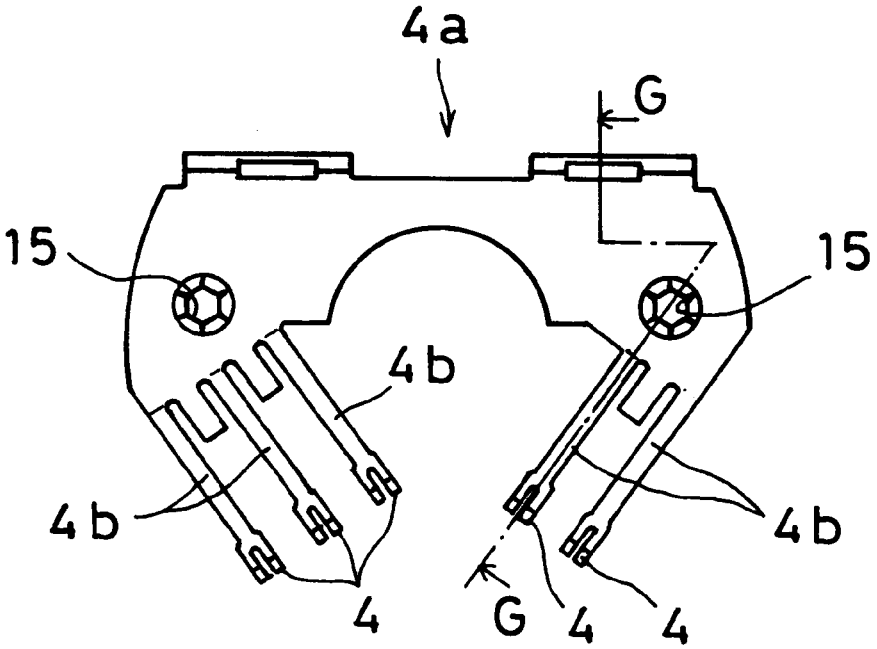
FIG. 20 is a front view illustrating the contact spring piece in the mode switch of FIG. 1.
Figure 21:
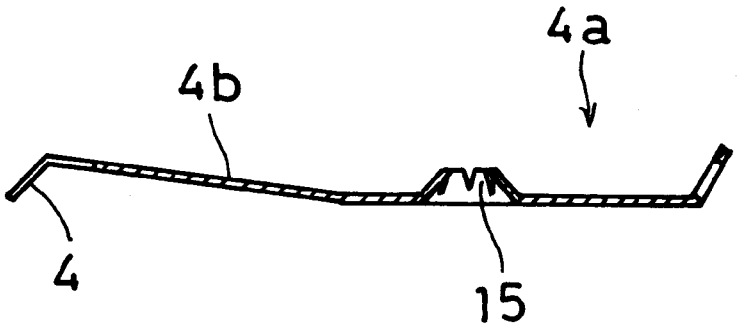
FIG. 21 is an enlarged cross-sectional view illustrating the contact spring piece, taken along the line G—G in FIG. 20.

Referring to FIGS. 20 and 21, the contact spring piece plate 4*a* includes the right and left portions of the sectorial metal spring plate. A predetermined number of strip-like contact spring pieces 4*b* have one ends acting as movable contacts 4 and are protruded from and integrally formed with the lower side of the right portion. A predetermined number of strip-like contact spring pieces 4*b* have one ends acting as movable contacts 4 and are protruded from and integrally formed with the lower side of the left portion. The right portion has a mounting hole 15 into which the respective support pillar 14 of the base 1 is inserted while the left portion has a mounting hole 15 into which the other support pillar 14 of the base 1 is inserted. With the contact spring piece plate 4*a* attached to the base 1, the movable contacts 4 of each contact spring piece 4*b* are relatively spaced from the stationary contact 2 formed on the base 1.

Figure 22:
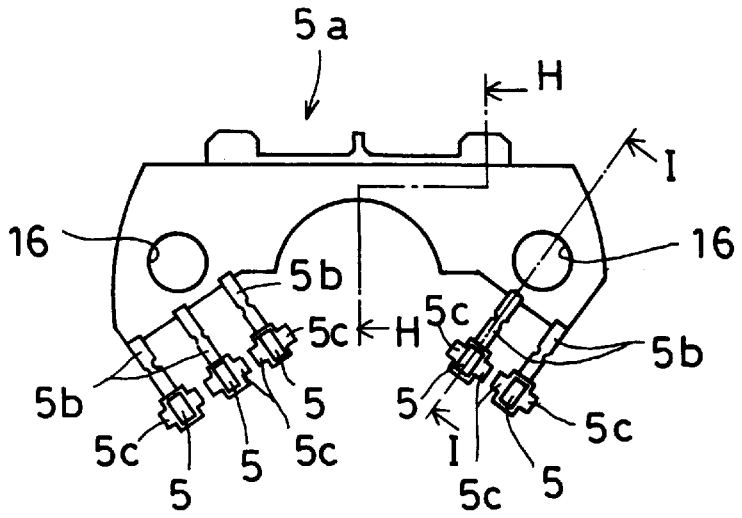
FIG. 22 is a front view illustrating the actuator plate in the mode switch of FIG. 1.
Figure 23:
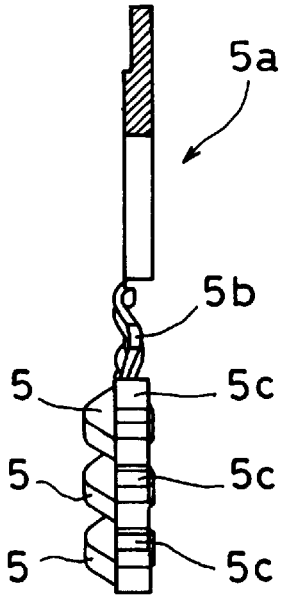
FIG. 23 is an enlarged cross-sectional view illustrating the contact spring piece, taken along the line H—H in FIG. 22.
Figure 24:
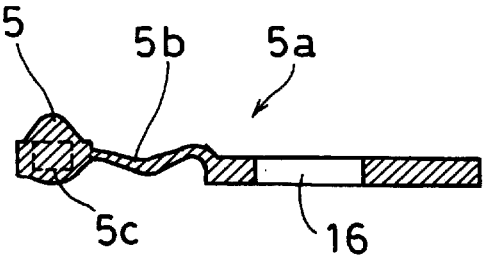
FIG. 24 is an enlarged cross-sectional view illustrating the contact spring piece, taken along the line I—I in FIG. 22.

Referring to FIGS. 22 and 24, the actuator plate 5*a* is an insulation plate of substantially the same size as the contact spring piece plate 4*a* and has actuators 5 arranged at positions corresponding to the contact spring pieces 4*b* of the contact spring piece plate 4*a*. The actuator plate 5*a* has insertion holes 16 respectively opened at positions corresponding to the mounting holes 15 in the contact spring piece plate 4*a*. The strip-like spring pieces 5*b* extend from the right and left lower portions of the insulation plate. An actuator 5 like an angled top is integrally formed at the tip of each spring piece plate 5*b*. A guide protrusion 5*c*, which engages to the guide groove or hole 13*a* of the guide support pillar 13 on the base 1, is formed on the right side surface of the actuator 5. A guide protrusion 5*c* which engages to the guide groove or hole 13*a* of the guide support pillar 13 on the base 1 is formed on the left side surface of the actuator 5.

The plate 4*a* is attached to the base 1 by respectively inserting the left and right support pillars 14 of the base 1 into the left and right mounting holes 15 of the contact spring piece plate 4*a*. The movable contacts 4 on the ends of the contact spring pieces 4*b* are placed so as to be relatively spaced from the stationary contacts 2 of the base 1, respectively.

The actuator plate 5*a* is placed over the contact spring piece plate 4*a* by respectively inserting the right and left support pillars 14 of the base 1 into the right and left insertion holes 16.

Thus, the actuators 5 make contact with the contact spring pieces 4*b*, respectively. The guide protrusion 5*c* of each actuator 5 is vertically and movably engaged with the guide groove or hole 13*a* in the guide support pillar 13 on the base 1.

The rotor 3 is placed over the actuator plate 5*a* so as to engage the hollow center shaft 6 with the center shaft 10 of the base 1. Moreover, the circumferential protruding stripe 12 of the base is engaged to the circumferential side plate 7. The engaging pawls 1*a* of the engaging pieces 11 engage with the engaging rim 8 of the circumferential side plate 7. The rotor 3 is rotatably mounted on the base 1.

Figure 8:
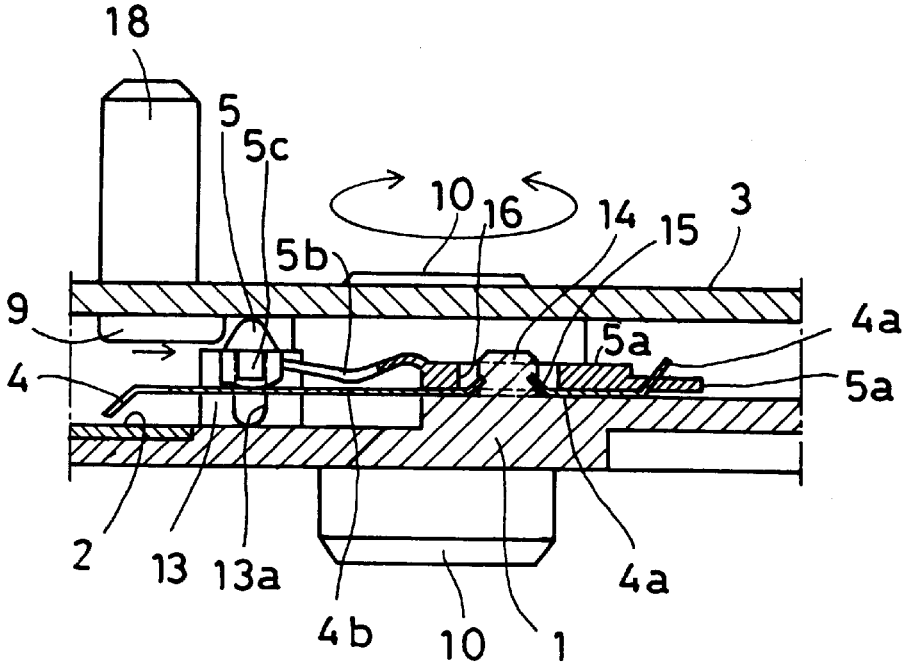
FIG. 8 is a diagram illustrating a mode switch in an OFF mode.
Figure 9:
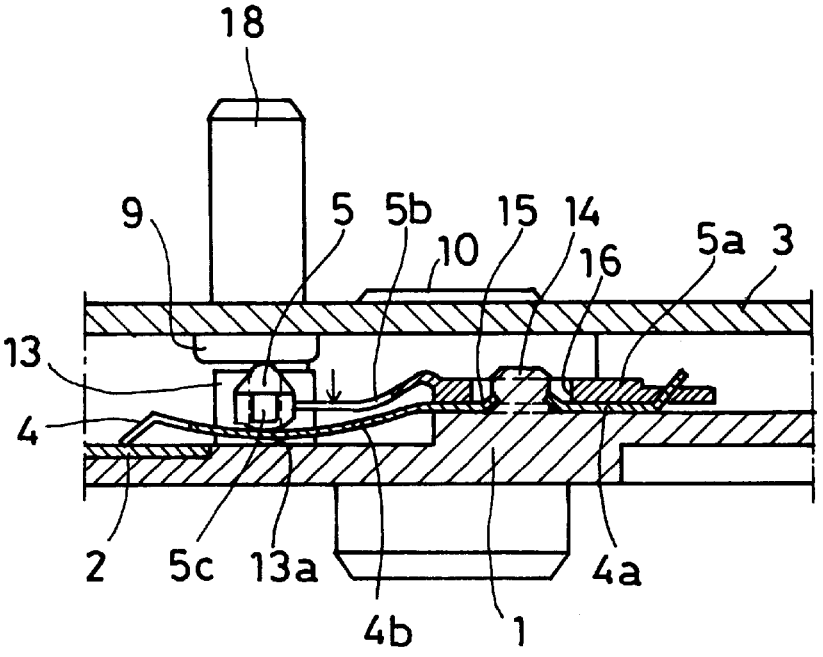
FIG. 9 is a diagram illustrating a mode switch in an ON mode.
Figure 10:
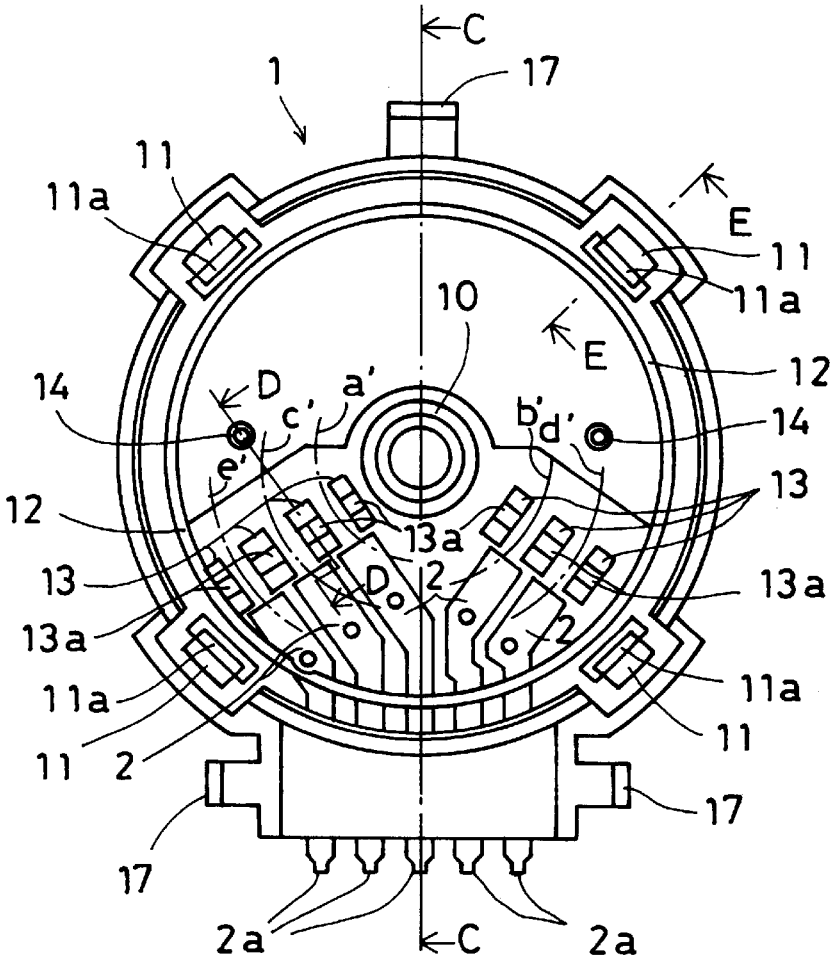
FIG. 10 is a front view illustrating the base in the mode switch of FIG. 1.
Figure 11:
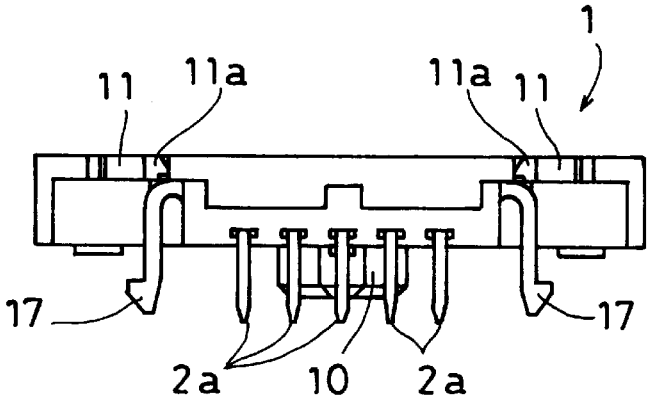
FIG. 11 is a bottom end view illustrating the base in FIG. 10.
Figure 12:
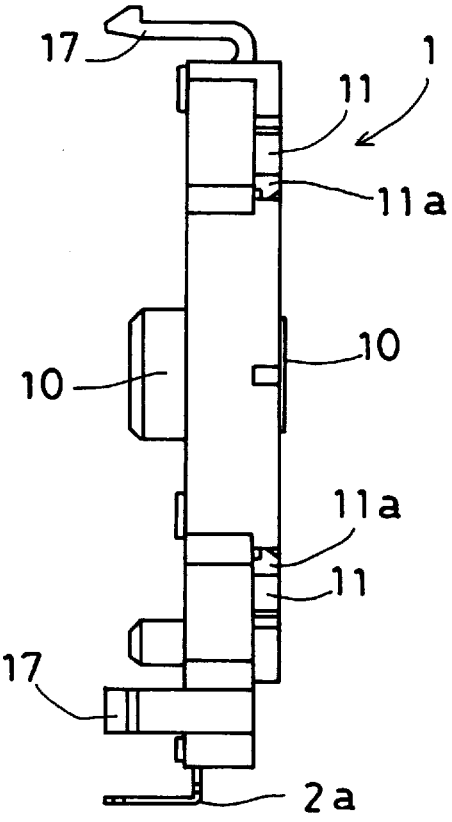
FIG. 12 is a left side view illustrating the base in FIG. 10.
Figure 13:
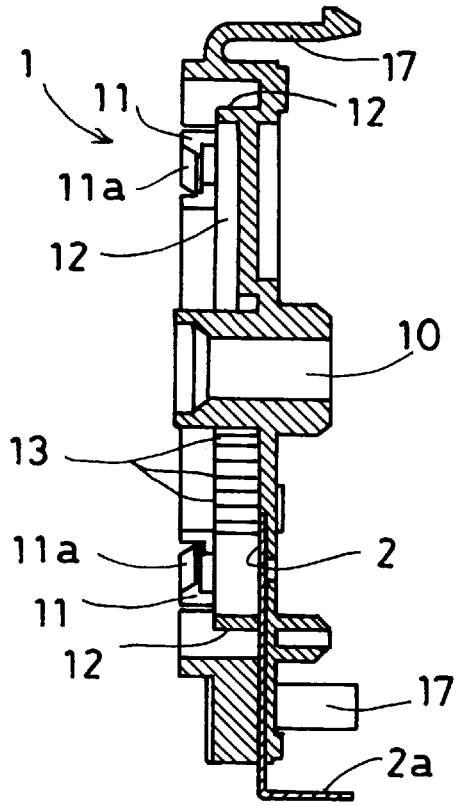
FIG. 13 is a cross-sectional view illustrating the base, taken along the line C—C of FIG. 10.
Figure 14:
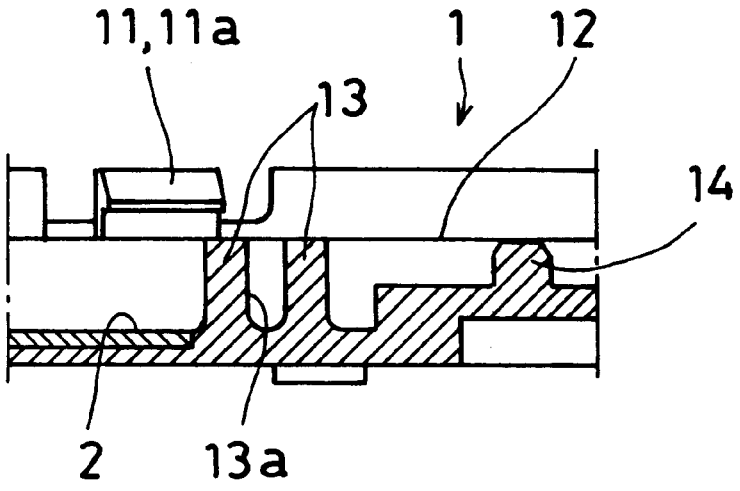
FIG. 14 is an enlarged cross-sectional view illustrating the base, taken along the line D—D of FIG. 10.
Figure 15:
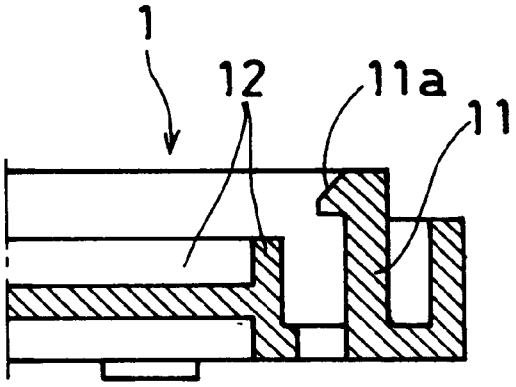
FIG. 15 is an enlarged cross-sectional view illustrating the base, taken along the line E—E of FIG. 10.
Figure 16:
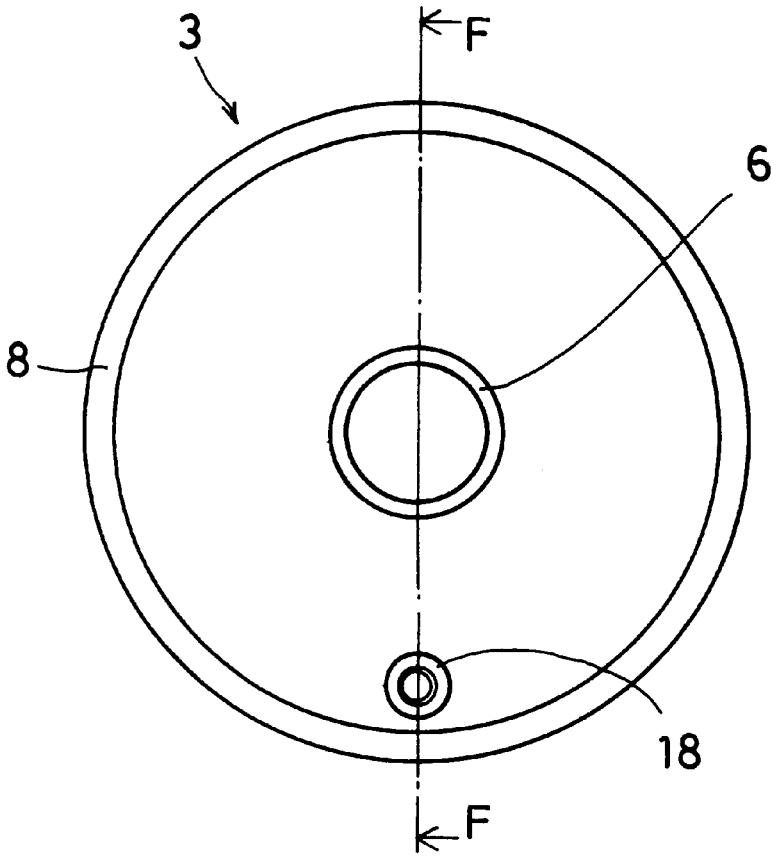
FIG. 16 is a front view illustrating the rotor in the mode switch of FIG. 1.
Figure 17:
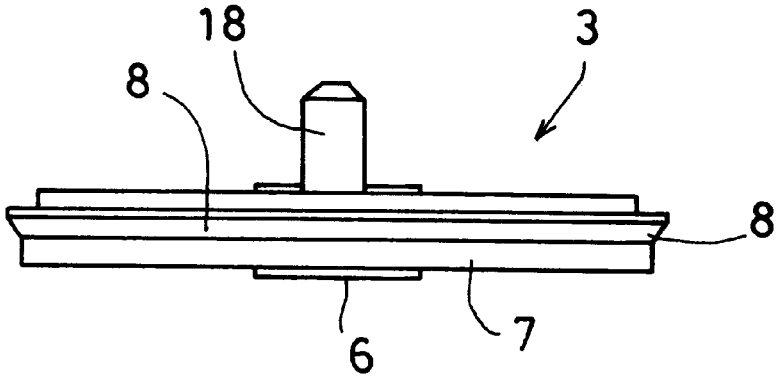
FIG. 17 is a bottom end view illustrating the rotor of FIG. 16.
Figure 18:
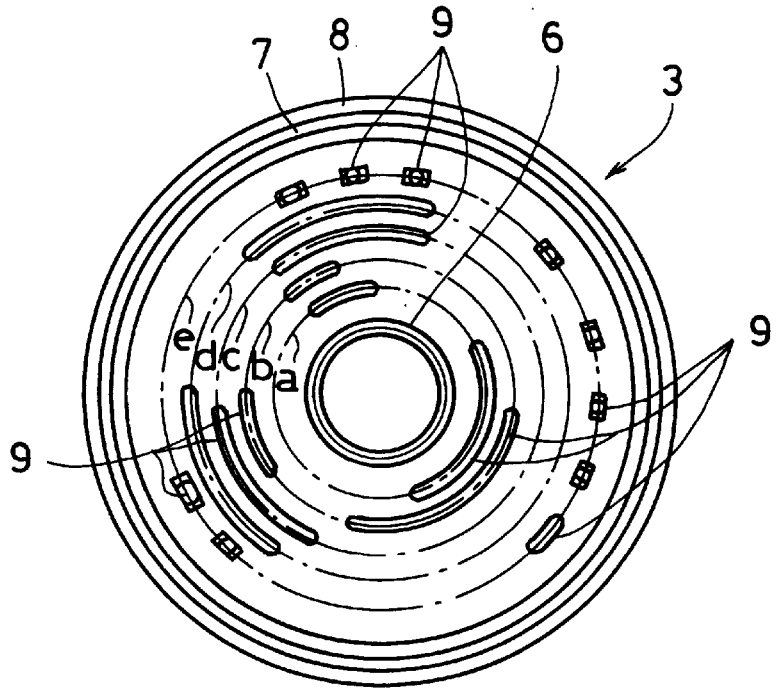
FIG. 18 a back end view illustrating the rotor of FIG. 16.
Figure 19:
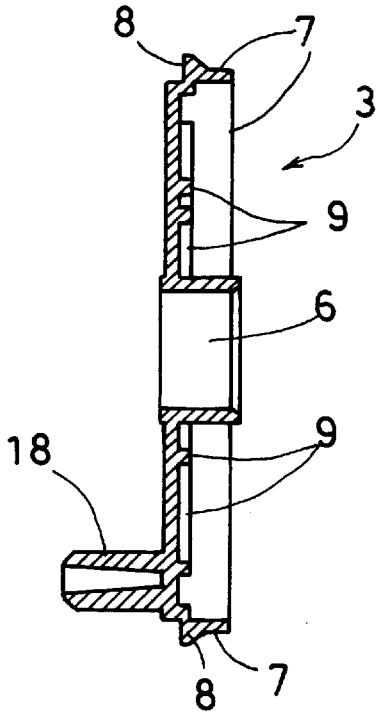
FIG. 19 is a cross-sectional view illustrating the rotor, taken along the line F—F in FIG. 16.

Referring to FIGS. 8 and 9, when the rotor 3 is rotated, the protruding stripe or protrusion 9 collides with and then rides on the actuator 5, so that the actuator 5 is vertically lowered by the guide protrusion 5*c* and along the guide groove or hole 13*a*. Finally, the contact spring piece 4*b* is pushed down so that the movable contact 4 is strongly contacted with the stationary contact 2 (that is, the mode switch is turned ON). When the rotor 3 is further rotated, the actuator 5 moves away from the protruding stripe 9 or protrusion 9, so that the contact spring piece 4*b* springs back to its original position. Thus, as the actuator 5 vertically rises, the movable contact 4 is separated from the stationary contact 2 (that is, the mode switch is turned OFF).

Figure 2:
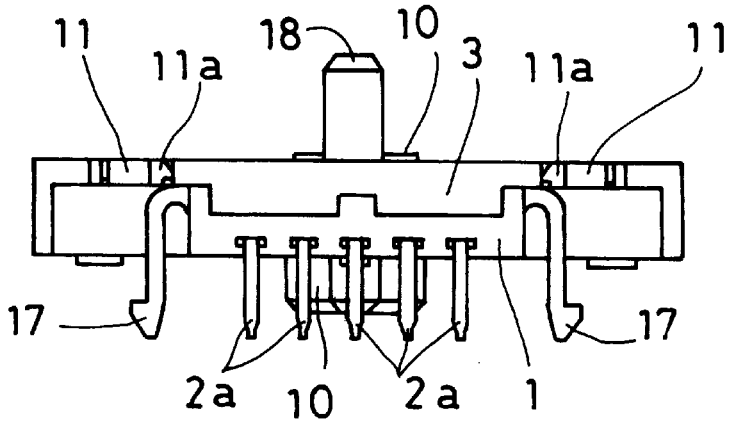
FIG. 2 is a bottom end view illustrating the mode switch of FIG. 1.
Figure 3:
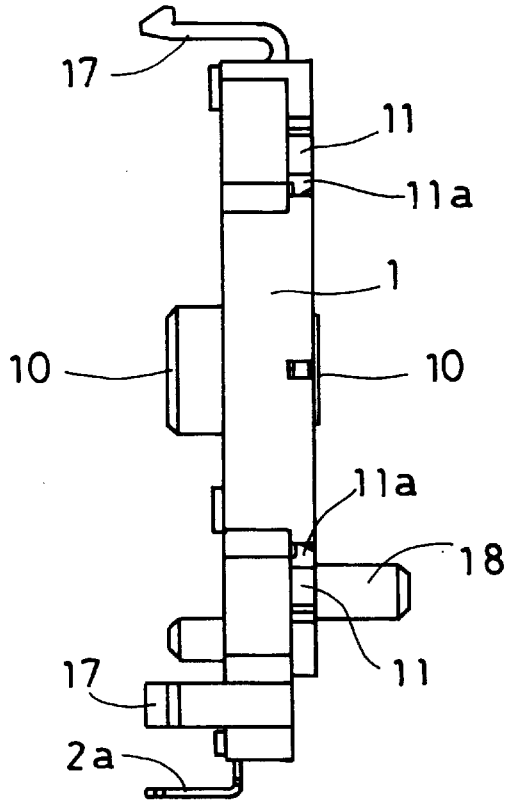
FIG. 3 is a left side view illustrating the mode switch of FIG. 1.
Figure 4:
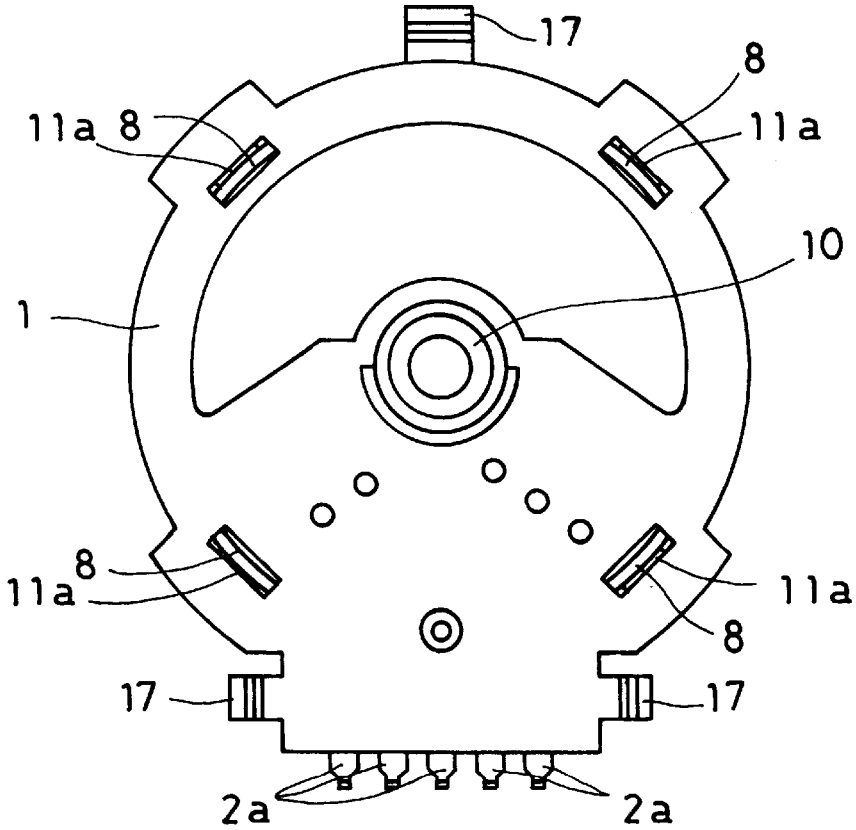
FIG. 4 is a back end view illustrating the mode switch of FIG. 1.
Figure 5:
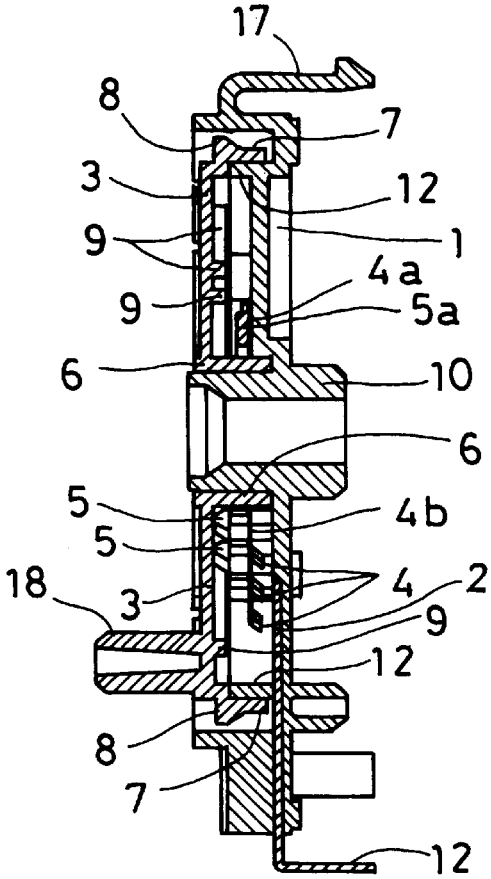
FIG. 5 is a cross sectional view illustrating the mode switch of FIG. 1, taken along the line A—A.
Figure 6:
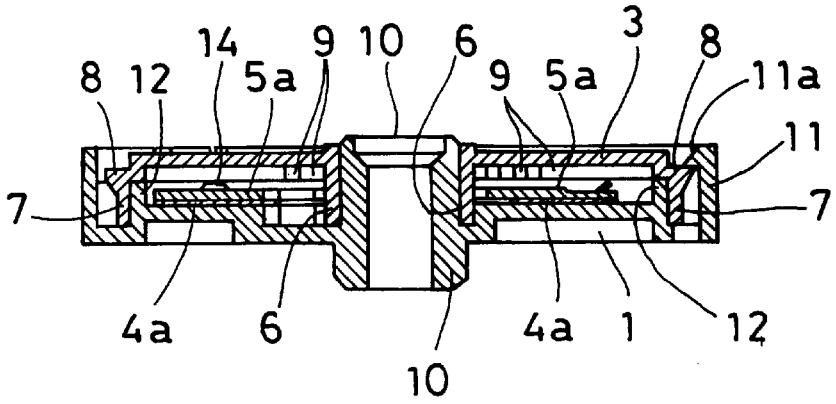
FIG. 6 is a cross sectional view illustrating the mode switch of FIG. 1, taken along the line B—B.
Figure 7:
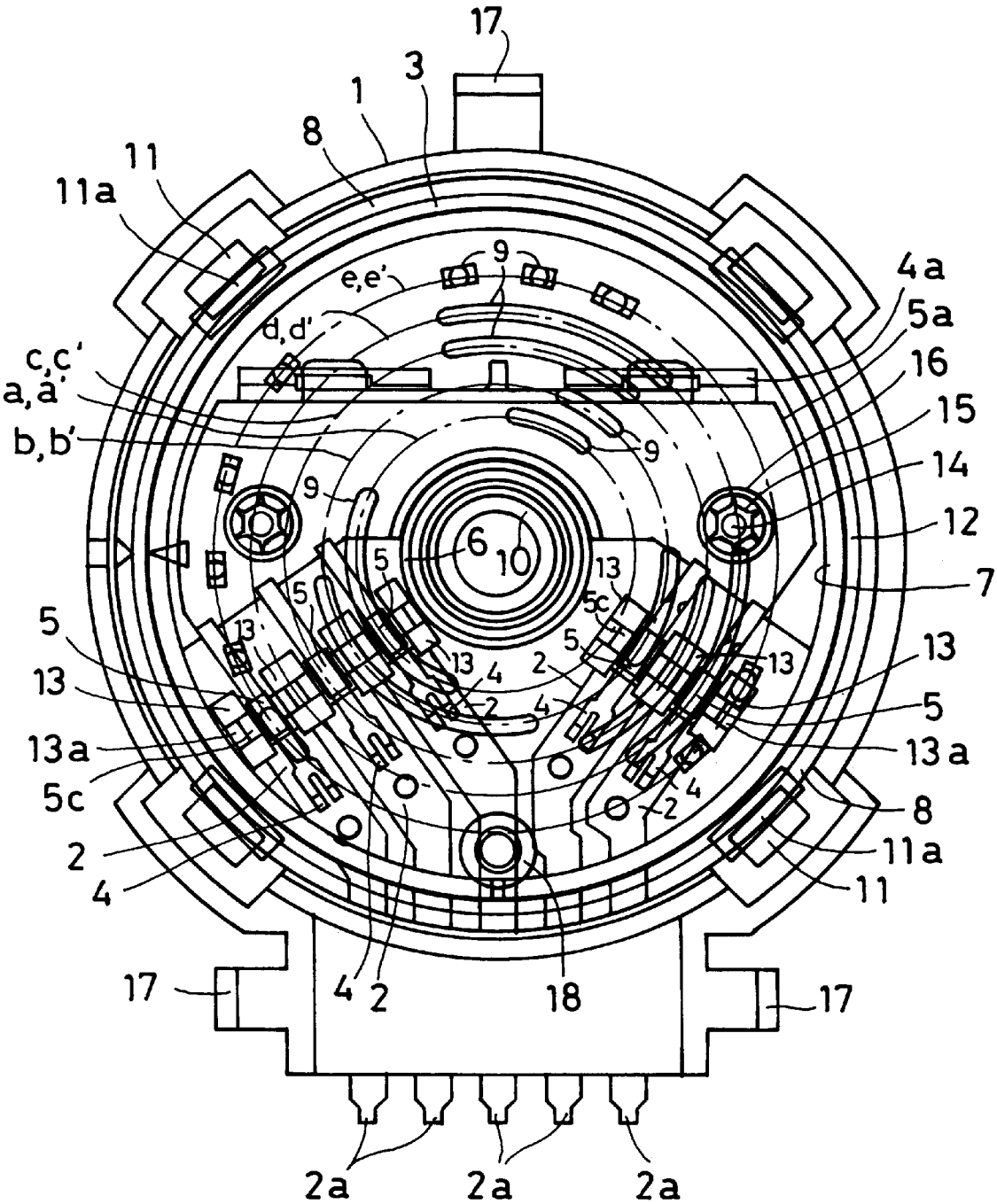
FIG. 7 is an enlarged perspective view explaining the mode switch of FIG. 1.

The actuator 5, formed on the end of each spring piece 5*b* of the actuator plate 5*a*, is formed, for example, in an angled top shape as shown in FIGS. 2 and 9, in a short round column, in a spherical shape, or in a rotatable roller. The guide protrusions 5*c* or shafts are formed on the left and right side surface of the actuator 5. The actuator plate 5*a* is vertically and movably fitted to the vertical guide groove or hole 13*a* formed in each guide support pillar 13 on the base 1.

The actuators 5 are respectively placed over the contact spring pieces 4*b* and between the contact spring pieces 4*b* and the rotor 3. Each actuator is in contact with the lower surface of the rotor 3 by means of the upward biasing force of the contact spring piece 4*b*. The actuator 5 vertically moves by the height of the protruding stripe 9 or protrusion 9 of the rotor 3 under the guidance of the guide protrusion 5*c* and the guide groove or hole 13*a*. The vertical movement is transmitted to the contact spring piece 4*b*. As a result, the contact spring piece 4*b* is bent upward by the same distance.

The contact (switch ON) time period and the separation (switch OFF) time period between the movable contact 4 and the stationary contact 2 in the rotating operation of the rotor 3 as well as the contact timing and the separation timing can be programmed by adjusting either the arc length or position of the protruding stripes or protrusions 9 protruding on the concentric circles a, b, c, d and e on the lower surface of the rotor 3, or the space between them.

The upper surfaces of the engaging pawls 11*a* of the engaging pieces 11 provided the base 1 are beveled while the lower surfaces of the engaging rims 8 protruding from the outer fringe surface of the circumferential side plate 7 of the rotor 3*e* are beveled.

When the rotor 3 is inserted between the engaging pieces 11 of the base 1 by bending the engaging pieces 11 outward, the beveled surface of the engaging rim 8 is slidably guided on the beveled surface of the engaging piece 11, so that the fitting between them is made smoothly.

In the mode switch according to the present invention, the arc protruding stripes or protrusions 9, which protrude at set positions of the concentric circles a to e imaginarily formed on the lower surface of the rotor 3, technically are symmetrical to the arc-like or spot-like stationary contacts where a metal pattern plates are partially exposed at set positions on the concentric circles 100*a* to 100*e* imaginarily drawn on the upper surface of the base 101 in the conventional mode switch.

In the conventional mode switch, while the rotor 101 is being rotated, with the brush (movable contact) 104 being slidably in contact with the arc-like stationary contact 102 of a predetermined length, signals (pulses) are continuously received and transmitted.

On the other hand, in the mode switch according to the present invention, while the actuator 5 is running into the arc-like protruding stripe 9 of a predetermined length by rotating the rotor 3, thus reversely bending the contact spring piece 4*b* such that the variable contacts 4 make contact with the stationary contacts 2 without sliding. Thus, the mode switch continues to transmit and receive signals (pulses).

Hence, in the mode switch according to the present invention, the stationary contacts 4 need not be formed in an arc stripe on the base 1 or are at predetermined positions of concentric circles a' to e'. In brief, the stationary contacts 4 simply confront their respective variable contacts of the contact spring pieces.

Reference numeral 17 represents a spring mounting leg (with an engaging pawl at the end thereof) for mounting a mode switch to a printed board or mechanical chassis with a single motion and reference numeral 18 represents a knob for rotating a rotor.

A mode switch according to the present invention is assembled as follows

First, the plate 4*a* is attached to the base 1 by inserting the right and left support pillars 14 on the base 1 into the right and left mounting holes 15 in the contact spring piece plate 4*a*, respectively. The movable contacts 4 at the ends of the contact spring pieces 4*b* are placed over the stationary contacts 2 on the base 1 so as to be relatively spaced from each other.

The plate 4*a* is securely attached to the base 1. The mounting hole 15 is shaped, for example, in a chrysanthemum form as the mounting means. The support pillar 14 is reversely engaged by the petal-like spring piece.

Next, the actuator plate 5*a* is placed on the contact spring plate 4*a*. Each actuator 5 is placed above each contact spring piece 4*b*.

The actuator plate 5*a* is placed by inserting the support pillars 14 into the left and right insertion holes 16. Unlike the contact spring piece plate 4*a*, the actuator plate 5*a* is somewhat loosely attached.

Next, the rotor 3 is placed over the actuator 5. In order to mount the rotor 3 to the base 1 rotatably, the rotor 3 is lowered from above the base 1 so that the center shaft 6 is inserted into the hollow center shaft 5 of the base 1. At the same time, the circumferential side plate 11 of the rotor 3 is fitted to the circular protruding stripe 13 of the base 1 while the beveled surface 12*a* of the engaging rim 12 of the rotor 3 is pushed against the beveled surface 9*b* of the engaging pawl 9 of the engaging piece 7. The support pillar 8 is lowered and bent outward according to the sliding of the beveled surfaces 12*a* and 9*b* so that the support pillar 8 is inserted downward into the receiving section 9*a* of the engaging pawl 9.

In such a situation, the outer circumference of the engaging rim 8 is inserted to the inner surfaces of the engaging pieces 11. The movable contacts 4 of the contact spring pieces 4*b* are bent to make strong contact with the stationary contacts on the base 1. The engaging rims 8 engage with the engaging pawls 11*a*. Thus, the rotor 3 is completely mounted on the base 1. In such a mounting state, the rotor 3 is rotatably and tightly set to the inner surface of the engaging pieces 11*a*. Thus, the mode switch of this embodiment according to the present invention is assembled.

In the completed mode switch, each actuator 5 is placed between the upper surface of each contact spring piece 4*b* and the lower surface of the rotor 3 and is biased upward by the contact spring piece 4*b*, thus pushed against the lower surface of the rotor 3.

When the rotor 3 is rotated with respect to the center of the hollow center shaft 6, the protruding stripe or protrusion 9 moves onto the actuator 5. The guide protrusion 5*c* vertically sinks by the height of the protruding stripe or protrusion 9 along the guide groove or hole 13*a*, thus reversely bending down the contact spring piece 4*b* by the corresponding distance. As a result, the contact 4 goes down and makes contact with the stationary contact 2 (that is, the mode switch is turned ON).

While the actuator 5 rests on the protruding stripe or protrusion, the contacts 4, 3 are in a contact state (that is, the mode switch is turned ON) so that the mode switch continues to receive and transmit signals (pulses).

When the rotor 3 is further rotated, the actuator 5 steps down from the protruding stripe or protrusion 9 to the insulation portion, thus moving upward by the stepped amount. At the same time, the contact spring piece 4*b* springs back so that the contacts 4, 2 are separated from each other (that is, the mode switch is turned OFF).

When the rotor 3 rotates, the actuator 5 which is biased toward the lower surface of the disk of the rotor, moves onto the protruding stripe or protrusion. Thus, the contact spring piece is bent downward under the downward pressure due to the vertical fall of the actuator 5, so that the movable contact is pressed against the stationary contact.

The rotation of the rotor is converted to the vertical movement of the actuator guided by the guide protrusion on the actuator at its normal position and by the guide groove or hole in the guide support pillar on the base, thus transferring only the downward pressure to the contact spring piece. Hence, the rotation of the rotor does not entirely affect the contact and separation operations of the contacts (that is, ON and OFF operations of the mode switch). Both the movable contact and the stationary contact carry out the ON/OFF operation by the same vertical movement as that of the push-type switch in which both contacts are vertically and respectively placed at a normal position, without frictionally sliding both contacts in the conventional mode switch. As a result, the mode switch does not require the application of grease on the contacts.

The actuator is formed on one end of the spring piece of an actuator plate. When the rotor is rotated, the actuator vertically moves at its normal position on the contact spring piece and along the guide groove or hole. Consequently, the actuator always moves accurately and vertically regardless of the rotation direction of the rotor. Hence, the movable contact accurately makes contact or separation with the stationary contact.

When the movable contact of the contact spring piece is dent downward, it is pushed down against the stationary contact because of the vertical descent of the actuator. Hence, the movable contact is strongly pushed against (or completely and electrically conducted to) the stationary contact while being frictionally slid with slight scratch. As a result, no chattering sound occurs between the contacts. Because the contact surface always remains in a polished state, the contact does not get rusted or stained, thereby preventing a conduction failure.

Since the movable contact touches the stationary contact at an accurate normal position, the plating area requiring a precious metal can be reduced, so that the manufacturing costs can be saved by the amount corresponding to the reduced space.

The rotor can be very effectively mounted to the base with a single motion in which the rotor is merely engaged with the engaging pieces by forcibly pushing down the rotor and bending the engaging pieces outward. As a result, the conventional mounting cover is not needed.

The present invention employs a plural point supporting system in which the engaging rim of the circumferential plate of the rotor makes contact with the inner surfaces of the engaging pieces and is positioned and supported without any wobbles. The present invention also employs the system of engaging the hollow center shaft with the center shaft and engaging the circumferential side plate with the circular protruding stripes. The synergistic effect of those systems allows the mounting position and the rotational position of the rotor to be set accurately, so that an accurate mode switch can be provided.

In the conventional mode switch, the entire circumference or upper surface of the rotor is covered with the mounting cover. However, according to the present invention, the stationary contacts and the movable contacts are covered with the circumferential side plate of the rotor and the circular-protruding stripe fitted each other,. Hence, the contacts and the contact portions can be effectively protected from dirt due to dust.

The distance between the upper surface of the base and the lower surface of the rotor can be accurately set by setting the pawls of an engaging piece to a predetermined height or setting the circumferential side plate and the circular protruding stripe to a predetermined height. Hence, the set distance can be determined without variations in quality among switches, unlike the conventional rough mounting cover. The contact pressure between the contact of a movable contact spring piece and a stationary contact is evenly maintained. This feature allows high precision mode switches to operate effectively.

What is claimed is:

1. A mode switch, comprising:

a base;

a rotor;

a contact spring piece plate; and an actuator plate, wherein:

said rotor is formed of an insulation disc plate having a lower surface and an outer circumferential fringe and includes a hollow center shaft protruding at a center portion of the lower surface of the insulation disc plate, a circumferential side plate protruding on the outer circumferential fringe of said insulation disc plate, engaging rims protruding from said outer circumferential fringe, and a predetermined number of arc protruding stripes or protrusions of a predetermined length arranged on said insulation disc plate at predetermined positions along a predetermined number of imaginary concentric circles centered with respect to the hollow center shaft;

said base is formed of a circular insulation substrate and includes a center shaft protruding from the center of an upper surface of said circular insulation substrate and configured to fit into the hollow center shaft of said rotor, engaging pieces disposed along an outer circumference of engaging rims of said circular insulation substrate at angles set on an imaginary circle concentric with said center shaft, said engaging pieces having edges acting as engaging pawls, circumference protruding stripes configured to fit to the circumferential side plate of said rotor with respect to the center shaft, right and left support pillars, and stationary contacts being exposed and formed on said base at positions adjacent to said imaginary concentric circles, said stationary contacts extending to respective terminals outside said circular insulation substrate;

said mode switch includes guide pillars facing said imaginary concentric circles on said rotor and being provided adjacent to said imaginary concentric circles, said guide pillars having guide grooves or holes respectively positioned along said imaginary concentric circles, said guide pillars being provided at positions bilaterally symmetrical to the center shaft to fit said contact spring piece plate and said actuator plate;

said contact spring piece plate has a predetermined number of contact spring pieces integrally and protrusively formed on lower sides of left and right plates of sectoral metal spring pieces, said contact spring pieces having first ends acting as movable contacts, each of said left and right plates having a mounting hole for fitting said right and left support pillars of said base, respectively, and said movable contacts of said contact spring pieces being positioned so as to be relatively spaced above the stationary contacts on said base while said contact spring piece plate is attached to said base;

said actuator plate is formed of an insulation plate of substantially the same shape as said contact spring piece plate and has actuators positioned so as to respectively face with the contact spring pieces of said contact spring piece plate, said actuator plate having insertion holes positioned so as to match the mounting holes of said left and right plates in said contact spring piece plate, said actuators being integrally formed on respective end portions of spring pieces integrally protruding from right and left side lower portions of said insulation plate, and guide protrusions configured to engage with the guide grooves or holes of said guide pillars of said base are formed on right and left side surfaces of said actuators, and wherein:

said contact spring piece plate is mounted to said base by inserting said right and left support pillars into said mounting holes of said left and right plates in said contact spring piece plate such that said movable contacts of said contact spring pieces are relatively spaced from said stationary contacts on said base;

said actuator plate is placed over said contact spring piece plate by inserting the right and left support pillars of said base into said insertion holes such that said actuators are in contact with said contact spring pieces and said guide protrusions of said actuators are vertically and movably engaged with said guide grooves or holes in said guide pillars on said base, respectively;

said rotor is placed over said actuator plate such that said rotor is rotatably mounted to said base by inserting said hollow center shaft thereof to the center shaft of said base, by inserting said circumferential protruding stripes of said base into said circumferential side plate and by engaging said engaging pawls of said engaging pieces of said base with said engaging rims of said circumferential side plate;

when said rotor is rotated, said arc protruding stripes or protrusions on the lower surface of said rotor collide with and run over respective ones of said actuators, thus vertically pushing down respective ones of said contact spring pieces under guidance of said guide grooves or holes, so that respective ones of said movable contacts make contact with respective ones of said stationary contacts under pressure; and when said rotor is further rotated, said respective ones of said actuators cross over said arc protruding stripes or protrusions, so that said respective ones of said contact spring pieces spring back, said respective ones of said actuators vertically rise to original positions before said arc protruding stripes or protrusions collided and run over said respective ones of said actuators, and said respective ones of said movable contacts are separated from said respective ones of said stationary contacts.

2. The mode switch of claim 1, wherein:

said actuators formed on said actuator plate are formed in at least one of an angled top shape, a short column shape, a spherical shape, and a rotatable roller shape, each of said actuators having guide protrusions or shafts protruding on the right and left side surfaces thereof;

said guide pillars are provided on said base so as to vertically and movably engage said guide protrusions into vertical guide grooves or holes;

said actuators are inserted between said contact spring pieces and said rotor such that upward biasing force of said contact spring pieces is directed toward the lower surface of said rotor; and said actuators vertically move by a height of the arc protruding stripes or protrusions of said rotor, thus transmitting the vertical movement to said contact spring pieces under the guidance of said guide grooves or holes to reversely bend said contact spring piece by the same distance.

3. The mode switch of claim 1, wherein a contact time interval and a separation time interval between respective movable and stationary contacts of said movable and stationary contacts as well as a timing thereof are programmed by adjusting respective arc lengths, positions and spaces of said arc protruding stripes or protrusions on the lower surface of said rotor.

4. The mode switch of claim 1, wherein:

the engaging pawls of said engaging pieces provided on said base have beveled upper surfaces;

the engaging rims protruding from the outer circumferential fringe of the circumferential side plate of said rotor have beveled lower surfaces; and said beveled upper and lower surfaces slidably guide said rotor for smooth fitting when said rotor is fitted between said engaging pieces of said base so as to bend each of said engaging pieces outward.

5. A mode switch comprising:

a base made of a circular insulation substrate and including at least one stationary contact;

a rotor made of an insulation disc plate and rotatably mounted on said base, said rotor being configured to rotate co-axially with respect to said base;

a contact spring piece plate disposed between said base and said rotor, said contact spring piece plate including at least one contact spring piece and at least one movable contact; and an actuator plate disposed over said contact spring piece plate between said base and said rotor, said actuator plate including at least one actuator which is configured to press said at least one contact spring piece such that said at least one movable contact makes contact with said at least one stationary contact when said rotor is rotated, wherein said at least one actuator is provided at an end portion of a spring piece which is configured to bias against force exerted on said at least one actuator.

6. The mode switch of claim 5, wherein said base includes a plurality of engaging pieces configured to keep said rotor movably mounted on said base.

7. The mode switch of claim 5, further comprising at least one guiding device configured to guide actuating movement of said at least one actuator.

8. The mode switch of claim 7, wherein said at least one guiding device comprises a plurality of guide grooves formed by a plurality of guide pillars disposed on said base and a plurality of guide protrusions provided on said at least one actuator and configured to fit in said plurality of guide grooves, respectively, such that said at least one actuator is guided to move along respective ones of said plurality of guide grooves.

9. The mode switch of claim 5, wherein said rotor includes at least one protrusion protruding toward said actuator plate, said at least one protrusion being configured to actuate said at least one actuator such that said at least one actuator presses said at least one contact spring piece.

10. The mode switch of claim 9, wherein said at least one protrusion comprises a protruding arc portion.

11. The mode switch of claim 10, wherein contact and separation time intervals between said at least one movable contact and said at least one stationary contact as well as a timing thereof are programed by adjusting a length and a position of said protruding arc portion.

12. A mode switch comprising:

a base made of a circular insulation substrate and including a plurality of stationary contacts;

a rotor made of an insulation disc plate and rotatably mounted on said base, said rotor being configured to rotate co-axially with respect to said base;

a contact spring piece plate disposed between said base and said rotor, said contact spring piece plate including a plurality of contact spring pieces and a plurality of movable contacts located at each of said plurality of contact spring pieces; and an actuator plate disposed over said contact spring piece plate between said base and said rotor, said actuator plate including a plurality of actuators, each of said plurality of actuators is configured to press a respective one of said plurality of contact spring pieces such that a respective one of said plurality of movable contacts makes contact with a respective one of said plurality of stationary contacts when said rotor is rotated, wherein each of said plurality of actuators are provided at an end portion of a respective spring piece which is configured to bias against force exerted on said plurality of actuators.

13. The mode switch of claim 12, wherein said base includes a plurality of engaging pieces configured to keep said rotor movably mounted on said base.

14. The mode switch of claim 12, further comprising a plurality of guiding devices configured to guide actuating movement of said plurality of actuators.

15. The mode switch of claim 14, wherein said plurality of guiding devices comprises a plurality of guide grooves formed by a plurality of guide pillars disposed on said base and a plurality of guide protrusions provided on each of said plurality of actuators and configured to fit in said plurality of guide grooves, respectively, such that each of said plurality of actuators is guided to move along respective ones of said plurality of guide grooves.

16. The mode switch of claim 12, wherein said rotor includes a plurality of protrusions protruding toward said actuator plate, each of said plurality of protrusions being configured to actuate at least one respective actuator among said plurality of actuators such that said at least one respective actuator presses a respective one of said plurality of spring pieces.

17. The mode switch of claim 16, wherein each of said plurality of protrusions comprises a protruding arc portion.

18. The mode switch of claim 17, wherein contact and separation time intervals between said plurality of movable contacts and said plurality of stationary contacts as well as a timing thereof are programed by adjusting respective lengths and positions of said plurality of protruding arc portions.

19. A mode switch comprising:

a base made of a circular insulation substrate and including at least one stationary contact;

a rotor made of an insulation disc plate and rotatably mounted on said base, said rotor being configured to rotate co-axially with respect to said base;

a contact spring piece plate disposed between said base and said rotor, said contact spring piece plate including at least one contact spring piece and at least one movable contact;

an actuator plate disposed over said contact spring piece plate between said base and said rotor, said actuator plate including at least one actuator which is configured to press said at least one contact spring piece such that said at least one movable contact makes contact with said at least one stationary contact when said rotor is rotated; and at least one guiding device configured to guide actuating movement of said at least one actuator, said at least one guiding device comprising a plurality of guide grooves formed by a plurality of guide pillars disposed on said base and a plurality of guide protrusions provided on said at least one actuator and configured to fit in said plurality of guide grooves, respectively, such that said at least one actuator is guided to move along respective ones of said plurality of guide grooves.

20. A mode switch comprising:

a base made of a circular insulation substrate and including a plurality of stationary contacts;

a rotor made of an insulation disc plate and rotatably mounted on said base, said rotor being configured to rotate co-axially with respect to said base;

a contact spring piece plate disposed between said base and said rotor, said contact spring piece plate including a plurality of contact spring pieces and a plurality of movable contacts located at each of said plurality of contact spring pieces;

an actuator plate disposed over said contact spring piece plate between said base and said rotor, said actuator plate including a plurality of actuators, each of said plurality of actuators is configured to press a respective one of said plurality of contact spring pieces such that a respective one of said plurality of movable contacts makes contact with a respective one of said plurality of stationary contacts when said rotor is rotated; and a plurality of guiding devices configured to guide actuating movement of said plurality of actuators, said plurality of guiding devices comprising a plurality of guide grooves formed by a plurality of guide pillars disposed on said base and a plurality of guide protrusions provided on each of said plurality of actuators and configured to fit in said plurality of guide grooves, respectively, such that each of said plurality of actuators is guided to move along respective ones of said plurality of guide grooves.

* * * * *